United States Patent [19]

Earley

[11] 4,038,913

[45] Aug. 2, 1977

[54] HAIR SPRAY EXHAUST SYSTEM

[76] Inventor: Sa Lomie C. Earley, Rte. 2, Box 631, Orangeburg, S.C. 29115

[21] Appl. No.: 686,579

[22] Filed: May 14, 1976

[51] Int. Cl.[2] ..... F23J 11/00

[52] U.S. Cl. ..... 98/115 R; 34/99

[58] Field of Search ..... 34/99, 100; 98/115 R

[56] References Cited

U.S. PATENT DOCUMENTS

| | | | |
|---|---|---|---|
| 1,464,297 | 8/1923 | Schodder | 98/115 R |
| 2,604,840 | 7/1942 | Loosli et al. | 98/115 R |
| 2,837,020 | 6/1958 | Gaspardo | 98/115 R |

*Primary Examiner*—Ronald C. Capossela

*Attorney, Agent, or Firm*—Townsend M. Belser, Jr.

[57] ABSTRACT

A ventilation system for beautician shops to exhaust aerosol hairspray from airspace adjacent to a customer's head during a hairstyling process. The exhausted airspace is defined by an inverted bowl of transparent material adjustably suspended over the beautician's chair by a counterbalanced telescopic ductwork communicating with a ceiling mounted exhaust fan assembly. Although exhausted air is preferably passed through a filter and recirculated back into the room, a modification of the invention exhausts unfiltered air to the building exterior.

10 Claims, 4 Drawing Figures

HAIR SPRAY EXHAUST SYSTEM

BACKGROUND

It is well known that in certain situations, air containing pollutants or other undesirable constituents, such as dust or odors, must be conducted away from a working station or a particular zone to be treated or transported to another place where it can be released without harm or nuisance to persons in the area. Hooded collecting means located in a position to receive the contaminated air are well known and, in general, a number of specialized air handling systems have been proposed for this purpose as represented by the following U.S. Pat. Nos.: 92,623 to Maguire of July 13, 1869, 3,380,371 to Scheel of Apr. 30, 1968, 3,412,530 to Cardiff of Nov. 26, 1968, 3,618,509 to Nichols of Nov. 9, 1971, 3,745,991 to Cauthier et al. of July 17, 1973, and 3,818,817 to Nederman of June 25, 1974.

BRIEF DESCRIPTION OF THIS INVENTION

The present ventilation system provides an improvement on these known structures for use in a beauty shop and particularly provides a structure adapted for use by a beautician to protect both the customer and the operator from air containing chemical propellants as used in many of the conventional hair spray aerosol dispensers. This invention makes use of a transparent inverted bowl supported above the customer's head and adjustable from a stand-by position into a position to cover approximately the top half of a person's head with sufficient space above the head and around the sides thereof for the operator to reach under the hood and manipulate the hair strands while spraying the hair with contents of the dispenser.

A suitable duct system is provided for supporting the hood so that it may be movably positioned where it is needed, the support means being also designed to make possible a circulation of air upwardly from the person's head for guiding the air flow into an exhaust means that may include air filtering means. The transparent hood and the entire air duct and fan system are preferably supported from a plenum chamber that can be attached to the ceiling of the beauty shop over the beautician's work station. With such a structure, the unit may be made fully self-contained, and this simple mounting arrangement provides a most serviceable and compact unit for easily controlling the air circulation around the customer's head. In combination with the unobtrusive positioning of the ventilating mean on the ceiling, the use of a transparent hood that may be moved quickly from one position to another makes it possible for the operator to easily manipulate the hood into position to protect both the customer and the operator from the nuisance, inconvenience and harmful effects of breathing air containing aerosol spray propellant and other particles projected into the air by hair spray containers.

The person primarily subjected to the hazards of propellant and other hair spray constituents is the operator who, under working conditions presently prevailing in beauty shops, is exposed to heavy concentrations of this material for forty or more hours per week. It is therefore a principal object of this invention to provide an improved ventilation means for the work station of operators in beauty parlors and the like.

It is another object of this invention to provide a ventilating means for the protection and safety of beauticians and their customers that may be easily moved into place and out of place with one hand while the beautician continues to manipulate the customer's hair.

It is another object of this invention to provide a transparent hood for use in circulating air upwardly around a customer's head and away from a beautician while the latter can observe and work with the hair throughout a spraying operation.

Another object is to provide a self-contained ventilating means for use at the work station in a beauty parlor to protect the customer and operator alike from aerosol propellant and particles issuing from hair spray dispenser means.

In addition to the numerous advantages apparent from the foregoing, the present invention has the further advantages of simplicity, ruggedness, durability, and ease and economy of construction and manufacture. The components of the present invention can be made in a conventional sheet metal shop using standard materials and parts which are commercially available, with the exception of the clear plastic bowl that must be specially ordered. The components can be put together and the structure assembled with relatively few machine tools. The exact nature of the invention as well as other objects and advantages thereof will be readily apparent from the annexed drawings and the following specific description of the preferred embodiment of the invention.

IN THE DRAWINGS

DETAILED DESCRIPTION

Figure 1:
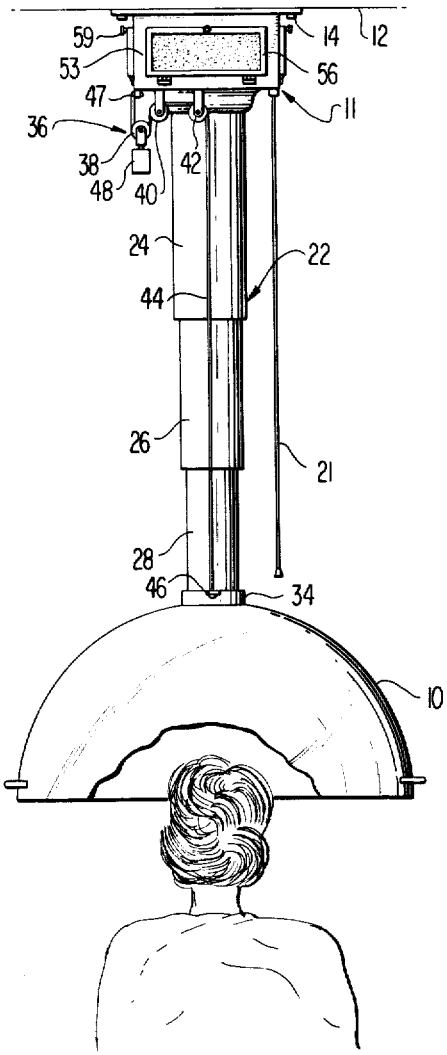
FIG. 1 is a rear elevation of the apparatus of this invention showing the transparent hood in its extended or lowered position around the customer's head.

The transparent hood 10 for surrounding the head of a customer is shown in its operative position in FIG. 1. The hood is supported by duct work, generally designated 22, depending from an air treating plenum chamber 11 positioned well above the head of a person seated at an operator's station in a beauty parlor or the like. The chamber 11, as will be described below, is preferably suspended from the ceiling 12 of the beauty parlor by suitable securing means, such as bolts 14. The unit is self-contained and all the elements are built into or supported from the plenum chamber means. The complete unit includes an extensible air duct suspended from the chamber for conveying air from the hood to the chamber, an air moving means for effecting the circulation of air, and the transparent hood supported at the lower end of the duct, the hood being designed to collect air from over and around the customer's head and feed it into the duct when the hood is lowered into the position shown in FIG. 1.

Figure 3:
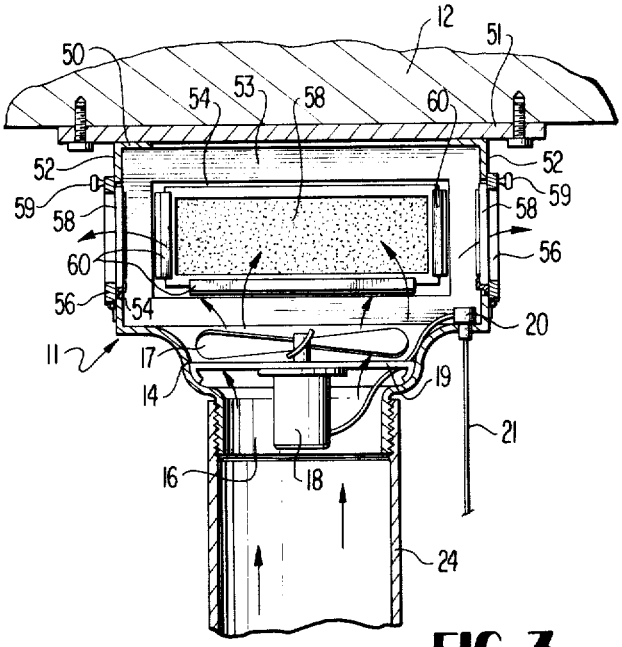
FIG. 3 is a fragmentary sectional view of one form of the invention taken on line 3—3 of FIG. 2.
Figure 4:
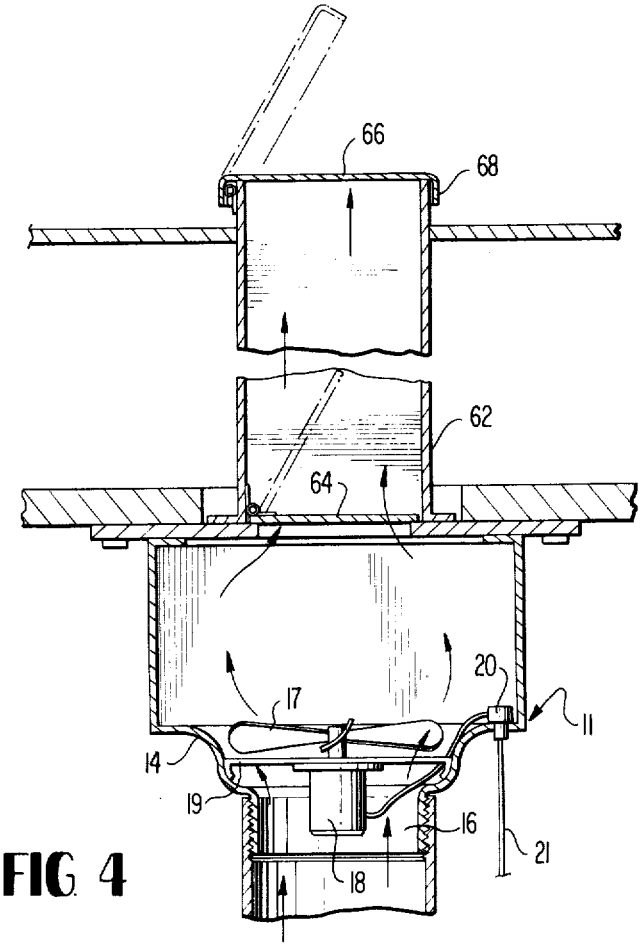
FIG. 4 is a fragmentary sectional view taken along a line similar to that of FIG. 3, but showing an alternate form of the apparatus.

The plenum chamber 11 is preferably made in the form of a substantially rigid six-sided, box-like member having side walls 52—52, front and rear walls 53—53, and a bell-shaped bottom wall 14 with an aperture therein formed by depending collar 16 as best seen in FIGS. 3 and 4. The air circulating means, in the form of a fan 17 driven by motor 18, is supported on a strut 19 within the bell-shaped bottom 14. The motor 18 may be connected to a source of electrical energy through a switch 20 operated by a pull cord 21.

Figure 2:
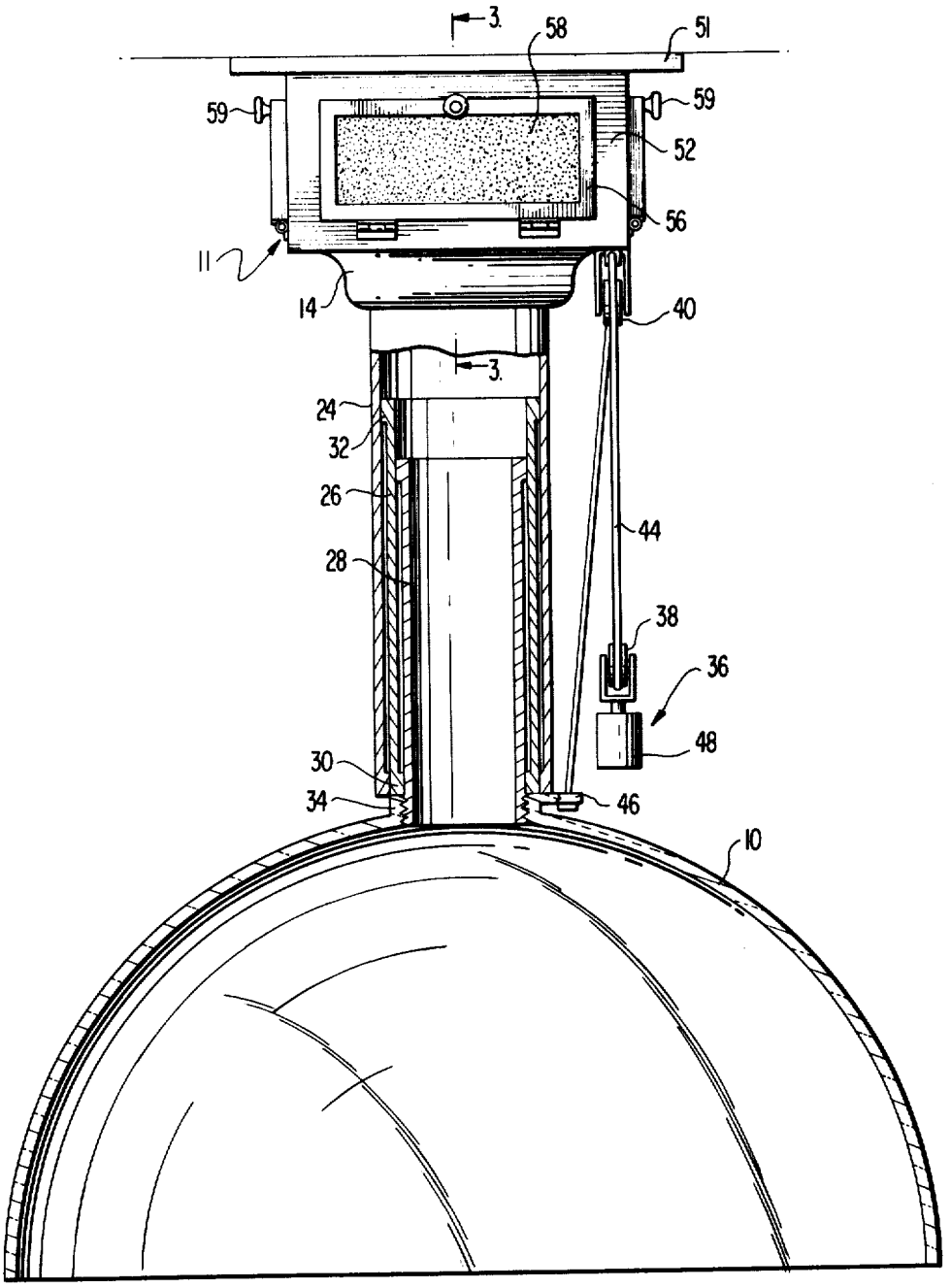
FIG. 2 is a side elevation of the apparatus, partly in section, showing the hood in its upper or retracted position.

The collar 16 that surrounds the aperture in the bottom of the bell-shaped bottom wall 14 constitutes an air inlet passageway into the plenum chamber. The outer surface of the collar wall may be threaded to receive an upper conduit section 24 forming a part of the air duct 22. The conduit section 24 is adapted to telescopically inter-fit with other conduit sections 26 and 28 as shown in FIGS. 1 and 2. The opposite ends of each of the several conduit sections may be provided with coacting shoulders 30 and 32, as shown in FIG. 2, that serve to limit the ultimate downward extension of the telescoping sections for the purpose discussed more fully below. The pipe sections may be made of any suitable material such as plastic piping or light weight aluminum alloy or the like. Where sheet metal ductwork is employed, the shoulders 30 and 32 are preferably of rolled construction.

The transparent bowl 10 is mounted at the lower end of the bottom section 28 so as to be carried in an inverted position from the lowermost end of the telescopic duct means 22. For this purpose, as shown in FIG. 2, the bowl element may be provided with an internally threaded collar 34 surrounding an aperture located generally at the center of the inverted bowl. The threaded collar 34 is adapted to be engaged by cooperating external threads at the lower end of the conduit section 28. With such a support structure, the bowl may be raised and lowered as the telescopic duct sections are moved one relative to the other.

The duct sections may be provided with friction means to hold them in any desired setting relative to one another. Preferably, they are freely slidable one within the other and the extension and contraction of the length of the duct controlled by a counterbalance means 36 which includes pulleys 38, 40 and 42 around which cable 44 passes. The cable is connected at one end to inverted bowl 10 by a bracket 46 integral with bowl collar 34 and at the other end to a lower corner of plenum 11 by a bracket 47. The weight 48 is raised and lowered with the movement of telescopic duct elements 24, 26 and 28, weight 48 having just sufficient mass operative through the pully system to balance the weight of the hood and telescopic conduits 26 and 28. It is seen that the hood may be thus easily moved from its raised position shown in FIG. 2, which allows free access to the working station thereunder, to a position determined by the operator for surrounding the head of a seated customer substantially as shown in FIG. 1. In this latter position, the transparent hood may be positioned as closely adjacent to the person's head as desired so that upwardly flowing air circulation produced when fan 17 is energized will cause a sufficiently positive but gentle upward draft to pull the air from around the head and collect and drive that air and its contents upwardly into the plenum chamber.

The box-like plenum chamber 11 may have a planar top 50 attached to a mounting board 51 designed to be mounted flush against the surface of ceiling 12 directly over the customer's chair at the beautician's work station. The interior of the box-like plenum chamber is further defined by the bell-shaped bottom 14 and by substantially identical sidewalls 52 and front and rear walls 53. Each of these walls preferably has a large aperture 54 therein that is adapted to be covered by a hinged door means 56 that forms a frame for a suitable filter means 58. The several filters 58 are removably attached to the inside surfaces of the door frames by slidingly fitting within channel means 60 attached to the inside of bottom and side members of each door frame 56. The filters may be treated with absorbents to remove any noxious gasses or particles from the air flowing out of the chamber and the filter elements may be easily removed for cleaning or replacement by opening the doors and sliding each element outward from between side channel member 60—60. Each door is normally fastened closed during use of the ventilation system by a conventional latching mechanism (not shown) operated by rotatable knob 59. Gasses pumped from hood 10 through telescopic duct 22 into the enclosed plenum chamber by fan means 17 must thus pass through the filters covering exit apertures 54. The filtered air is discharged into the room while the objectionable particles and aerosol solvents or other harmful airborne contaminants are retained on the filters.

In a modification of the invention, the plenum chamber 11 may be constructed as shown in FIG. 4. In this form of ventilating means, an upwardly extending stack or passageway 62 leads from the enclosed exhaust chamber to the outside atmosphere. Suitable one-way valve means, such as hinged flaps 64 and 66 may be mounted to normally seat against fixed stops in order to close the passageway 62 against reverse flow from the outside atmosphere. Flaps 64 and 66 are of light weight material, or may be counterbalanced, so that when fan 17 is energized, the pressure of the gasses flowing from the plenum chamber is sufficient to hold the flaps open and permit the unwanted gasses and particles entrained therewith to escape into the atmosphere outside of the building. The outer valve element 66 may be provided with a depending shirt 68 which, in the closed position of the valve, serves to further seal the passageway 62 against rain and wind when the fan is inoperative.

It can be seen that the ventilating apparatus described above is ideally suited for the purpose of protecting the customer and the operator from undue exposure to aerosol solvents and the like, as well as suspended particles, released in hair spraying operations at beauty parlors. The hood 10 is initially lowered from its retracted position to an operative position substantially surrounding as much of the customer's head as desired. The hood is made of clear plastic and although its precise dimensions are not critical, it is essential that the hood be of a size to create positive air flow in the immediate vicinity of the person's head while allowing directional application of the hair spray stream discharged by the aerosol dispenser. A bowl 32 inches in diameter and 16 inches deep is adequate to meet these criteria. This size permits the operator to reach under the hood to arrange the air strands as desired and then spray the hair while looking through the plastic hood. Still the hood is close enough to collect and funnel all of the air in the space between the head and the bowl into the duct means to be delivered into the plenum chamber 11.

The air flowing into and through the exhausted space picks up the aerosol gasses and any stray particles and the stream moves in a gentle but positive direction upwardly through the hood and flows through collar 34 into the telescopic duct means. The velocity of the flow as it enters between the person's head and the lower mouth of the hood is such that the air stream positively picks up aerosol solvent and hair spray particles without disturbing the hair. The flow velocity does not increase substantially until the air stream enters collar 34 well away from and above the hair. This control of air velocity, as can be readily understood, is inherent in the hood arrangement shown in FIG. 1. Thus, the aerosol gasses and spray particles are positively removed from the space surrounding the hair of the customer without subjecting the customer or operator to the nuisance and danger of inhaling unpleasant gasses or particles while the hair is being arranged. This is particularly advantageous to the operator who must dispense hair spray almost constantly throughout the workday. The operator at all times is able to observe the application of the spray onto the hair. After each hair treatment has been completed, the counterbalanced hood is easily lifted to the stored position shown in FIG. 2 so that the customer may get out of the chair and the operator can move freely about at the work station.

Although the dimensions of the hood are not critical, it is apparent that while positive flow is to be maintained, space must be allowed between the person's head and the hood to allow the operator to reach under the hood with a spray dispensing means or the like so as to reach all portions of the hair to be styled. Thus, the bowl dimensions given above can be varied only to a limited extent. The specific embodiment described is properly dimensioned for the purposes here disclosed. In addition, the bowl can be adequately removed from the operating station by raising it at least two feet above its lowermost or operative position, the latter being with the bowl exhaust aperture about 8 inches above the normal head position of a seated customer.

Although only two embodiments of the present invention have been described, other embodiments and variations will occur to those skilled in the art. It is possible, of course, to use various features of the specific embodiments described, either separately or in various combinations, and such uses are within the contemplation of the present invention. Furthermore, many structural changes are possible and are intended to be within the scope of this disclosure. It is also to be understood that the foregoing drawings and specification merely illustrate and describe preferred embodiments of the invention and that other embodiments are contemplated within the scope of the appended claims.

I claim:

1. A self-contained ventilating unit for use at a beautician's work station or the like to gently circulate air in the airspace surrounding hair on a customer's head and exhaust the air and entrained hairspray and the like upwardly and away from the customer and the operator, which unit comprises a transparent hood means for the operator to view all hair on the customer's head from positions thereabove, said hood means being adapted to be positioned adjacent to and defining an inlet to the airspace surrounding the customer's head to be ventilated; duct means connected to said hood to convey the air flow away from said ventilated airspace, said duct means being adjustable between an operative position with said hood adjacent to said airspace and a stored position away from said work station; a plenum chamber having inlet and outlet passage means with said duct connected to said inlet passage and said outlet passage leading to ambient air; and air circulating means for drawing ambient air into the inlet defined by said hood means and through said airspace surrounding the customer's head and creating an air flow into said duct to exhaust the air and extrained hairspray from the hood through the duct to the plenum chamber.

2. A ventilation unit as claimed in claim 1 including mean to support the plenum chamber over the customer's head and wherein said duct mean is extensible and retractable to permit said hood to be raised above said work station and lowered around said airspace.

3. A ventilation unit as claimed in claim 2 wherein said work station is positioned within a confined area under a ceiling and said plenum chamber is suspended from said ceiling.

4. A ventilation unit as claimed in claim 3 wherein said plenum chamber includes filter means arranged to remove said entrained material from the air being circulated and said plenum outlet means returns circulated air to said confined area.

5. A ventilation unit as claimed in claim 2 wherein said duct means includes a fixed conduit element mounted on said plenum and at least one conduit element movable with said hood and telescopically connected to said fixed element, said elements being arranged for extensible sliding movement relative to each other, and wherein said unit includes means for counterbalancing the weight of said hood and movable conduit whereby said hood may be easily raised and lowered as needed.

6. A ventilation unit as claimed in claim 2 wherein said plenum chamber is in the form of an enlarged rectangular box comprised of sidewalls having apertures therein which constitute said outlet passage means, and hinged frame means carried on said sidewalls and extending around said apertures, said frame means being arranged to support filter means for covering said apertures to filter circulated air passing through said outlet passage means on its way to the ambient air.

7. A ventilation unit as claimed in claim 6 wherein said inlet passage is in the bottom of the box and said air circulating means is carried on the box at said inlet passage.

8. A ventilation unit as claimed in claim 2 wherein said air circulating means is mounted on said plenum chamber between said inlet and outlet passage means to minimize the weight carried on the duct means.

9. A self-contained ventilating unit adapted for use at a beautician's work station in a beauty parlor or the like to gently circulate air in the airspace surrounding hair on a customer'head and exhaust the air and any entrained material upwardly and away from the customer and the operator, which unit comprises a hood adapted to be movably positioned to substantially surround the upper part of the customer's head in a manner defining the airspace to be ventilated and an ambient air inlet to said airspace, said hood being of a transparent material permitting hair on said part of the customer's head to be viewed by the operator from positions thereabove; a vertically disposed air duct connected to said hood to conduct air between the customer's head and the hood away from the customer and the operator, said air duct being formed of a plurality of telescopically connected conduit elements arranged for vertical adjustment; a generally horizontally disposed box-shaped plenum chamber fixedly mounted above the head of said customer and arranged to receive the air flowing through said duct from said hood, said plenum chamber being defined by top, bottom and sidewalls and having an inlet opening in its bottom wall and an outlet opening to ambient air in at least one of it sidewalls, said duct being connected at the upper end to said inlet opening to deliver air from around the customer's head to said chamber, and said hood being mounted at the lower end of said duct to be adjustably positioned adjacent to and away from the head of the customer by manipulation of said telescoping conduit elements; means to circulate air from said transparent hood through said air duct and plenum chamber and out said outlet opening; and air filtering means arranged to cover said outlet opening to filter the air being circulated and remove said entrained material.

10. A self-contained ventilating unit as described in claim 9 wherein the transparent hood is defined by a wall of transparent plastic material spaced from the customer's head when the hood is lowered to provide a working space into which the hand of an operator and a spray dispensing means can be inserted for arranging the customer's hair and treating it with hair spray.

* * * * *